US009328731B2

(12) United States Patent
Yabe et al.

(10) Patent No.: US 9,328,731 B2
(45) Date of Patent: May 3, 2016

(54) OIL FREE COMPRESSOR SYSTEM

(75) Inventors: Toshiaki Yabe, Shizuoka (JP); Natsuki Kawabata, Shizuoka (JP); Masakatsu Okaya, Shizuoka (JP); Kohei Sakai, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 302 days.

(21) Appl. No.: 13/528,060

(22) Filed: Jun. 20, 2012

(65) Prior Publication Data

US 2013/0136643 A1 May 30, 2013

(30) Foreign Application Priority Data

Nov. 30, 2011 (JP) ..... 2011-261182

(51) Int. Cl.

| | |
|---|---|
| ***F01C 21/04*** | (2006.01) |
| ***F01C 21/06*** | (2006.01) |
| ***F03C 2/00*** | (2006.01) |
| ***F03C 4/00*** | (2006.01) |
| ***F04C 2/00*** | (2006.01) |
| ***F04C 15/00*** | (2006.01) |
| ***F04C 27/02*** | (2006.01) |
| ***F04C 29/04*** | (2006.01) |
| ***F04C 18/16*** | (2006.01) |
| ***F01C 21/00*** | (2006.01) |
| ***F04C 29/02*** | (2006.01) |

(52) U.S. Cl.

CPC ..... *F04C 18/16* (2013.01); *F01C 21/007* (2013.01); *F04C 29/02* (2013.01); *F04C 29/04* (2013.01)

(58) Field of Classification Search

CPC ..... F01C 21/007; F04C 18/16; F04C 29/02; F04C 29/04

USPC ..... 418/9, 83, 85, 201.1; 417/243, 313, 417/321, 367, 410.3, 410.4

See application file for complete search history.

(56) References Cited

U.S. PATENT DOCUMENTS

| | | | | |
|---|---|---|---|---|
| 7,708,538 | B2 * | 5/2010 | Kawabata et al. | 418/83 |
| 2002/0001531 | A1 * | 1/2002 | Takahashi et al. | 418/9 |
| 2003/0059326 | A1 | 3/2003 | Douzono et al. | |
| 2008/0050257 | A1 * | 2/2008 | Kawabata et al. | 418/9 |
| 2010/0135840 | A1 | 6/2010 | Fujimoto et al. | |
| 2012/0251372 | A1 * | 10/2012 | Nishimura et al. | 418/201.1 |

FOREIGN PATENT DOCUMENTS

| | | | |
|---|---|---|---|
| JP | 11-141488 | A | 5/1999 |
| JP | 2002-155879 | A | 5/2002 |
| JP | 2007-332788 | A | 12/2007 |

OTHER PUBLICATIONS

English translation of Japanese Office Action dated Nov. 25, 2014 (four (4) pages).

* cited by examiner

*Primary Examiner* — Kenneth Bomberg
*Assistant Examiner* — Dapinder Singh
(74) *Attorney, Agent, or Firm* — Crowell & Moring LLP

(57) ABSTRACT

An oil free compressor includes a cooling fan, a low-pressure stage air-cooled heat exchanger, a high-pressure stage air-cooled heat exchanger, and a lubricating oil air-cooled heat exchanger. The cooling fan is provided independently from each of the low-pressure stage air-cooled heat exchanger, the high-pressure stage air-cooled heat exchanger, and the lubricating oil air-cooled heat exchanger.

17 Claims, 5 Drawing Sheets

(1) FLOW OF COMPRESSOR DRIVING MOTOR COOLING WIND
(2) FLOW OF AIR-COOLED HEAT EXCHANGER COOLING WIND

PRIOR ART

OIL FREE COMPRESSOR SYSTEM

This application claims the priority of Japanese Patent Application No. JP 2011-261182, filed Nov. 30, 2011, the disclosure of which is expressly incorporated by reference herein in its entirety.

TECHNICAL FIELD

The present subject matter relates to a package-type oil free screw compressor.

BACKGROUND

Patent Document 1 describes one example of a conventional oil free screw compressor. In this conventional one, cooling devices such as air-cooled heat exchangers (an inter cooler, an after cooler, an oil cooler, etc.) are arranged on a back surface of a compressor main body or driving system devices (a motor, a gear casing, etc.). The coolers forming the cooling devices are so arranged as to be exposed to a back surface of the package to take outside air at low temperature directly into the coolers, thereby achieving downsizing of the coolers.

Moreover, in a conventional art described in Patent Document 2, air-cooled heat exchangers (an inter cooler, an after cooler, an oil cooler, etc.) are arranged on one side isolated from a compressor main body and driving system devices inside a package.

PRIOR ART LITERATURE

Patent Documents

[Patent Document 1] Japanese Patent Application Laid-open No. 2002-155879

[Patent Document] Japanese Patent Application Laid-open No. H11 (1999)-141488

SUMMARY

In Patent Document 1 described above, the devices such as the coolers forming the cooling devices are structured to be exposed to the back surface for direct communication, thus resulting in a drawback such that vibrating sound and pulsating sound easily leak from a front surface of a cooler part.

Moreover, in Patent Document 2 described above, since the air-cooled heat exchanges (the inter cooler, the after cooler, the oil cooler, etc.) are arranged on one side isolated from the compressor main body and the driving system devices inside the package, a pipe length connecting together the compressor main body and the air-cooled heat exchangers increases and pressure loss increases, thus leading to performance deterioration of the compressor. Moreover, the pipe length increase results in an increase in noise generated by pipe vibration and also a disadvantageous structure in terms costs.

In view of the problems described above, the present subject matter has been made, and it is an object of the subject matter to provide a compact oil free screw compressor capable of reducing noise, ensuring a cooling capability of heat exchangers, and further reducing an installation area.

To achieve the object described above, for example, configuration described in the scope of the claims is adopted. This application includes a plurality of means adapted to achieve the object described above, and its one example is: an oil free screw compressor including: a low-pressure stage compressor boosting air to predetermined intermediate pressure; a high-pressure stage compressor booting compressed air, which was booted to intermediate pressure, to predetermined discharge pressure; a motor driving the low-pressure stage compressor and the high-pressure stage compressor; a low-pressure stage air-cooled heat exchanger cooling compressed air discharged from the low-pressure stage compressor; a high-pressure stage air-cooled heat exchanger cooling the compressed air discharged from the high-pressure stage compressor; a lubricating oil air-cooled heat exchanger cooling lubricating oil supplied to a bearing part of the compressor main body and a speed changer; a cooling fan for wind passage through the low-pressure stage air-cooled heat exchanger, the high-pressure stage air-cooled heat exchanger, and the lubricating oil air-cooled heat exchanger; a package covering the various parts; a duct arranged above the low-pressure stage compressor, the high-pressure stage compressor, and the motor in the package; and a cooling fan disposed in the duct and supplying cooling wind in a circumferential direction, in which the low-pressure stage air-cooled heat exchanger, the high-pressure stage air-cooled heat exchanger, and the lubricating oil air-cooled heat exchanger are arranged in a circumferential direction and a top surface side of the cooling fan in the duct, and an exhaust duct is provided which couples between the low-pressure stage air-cooled heat exchanger, the high-pressure stage air-cooled heat exchanger, and the lubricating oil air-cooled heat exchanger and a top surface of the package.

Moreover, detailed examples of an even more preferable mode are as follow:

(1) The high-pressure stage air-cooled heat exchanger is arranged on a top surface of the duct, and the low-pressure stage air-cooled heat exchanger and the lubricating oil air-cooled heat exchanger are respectively arranged on different side surfaces of the duct.

(2) The low-pressure stage air-cooled heat exchanger is vertically arranged on the side surface of the duct in a manner such that compressed air inlet and outlet of the low-pressure stage air-cooled heat exchanger are respectively located on a side of the low-pressure stage compressor and a side of the high-pressure stage compressor.

(3) The lubricating oil air-cooled heat exchanger is arranged on a lower side of the high-pressure stage air-cooled heat exchanger in a manner such as to partially overlap the high-pressure stage air-cooled heat exchanger when viewed from top of the duct.

(4) Part of a pipe connecting together the high-pressure stage compressor and the high-pressure stage air-cooled heat exchanger is arranged in an exhaust duct provided downstream of the low-pressure stage air-cooled heat exchanger.

(5) A front-stage air-cooled heat exchanger is included on an upstream side of the high-pressure stage air-cooled heat exchanger, and the front-stage air-cooled heat exchanger is arranged in an exhaust duct coupling between the low-pressure stage air-cooled heat exchanger and the package.

(6) A rectifying plate is provided on an upstream side of the high-pressure stage air-cooled heat exchanger.

(7) A high-temperature air exhaust part downstream of the high-pressure stage air-cooled heat exchanger is covered.

(8) A low-temperature side of the exhaust duct of the low-pressure stage air-cooled heat exchanger is covered.

(9) A rectifying plate is provided inside of the exhaust duct of the low-pressure stage air-cooled heat exchanger in a manner such as to permit a flow of much of cooling wind to the front-stage air-cooled heat exchanger.

(10) A passage is provided which bypasses the cooling wind from the upstream side to a downstream side of the low-pressure stage air-cooled heat exchanger.

(11) A passage is provided which passes through a high temperature part inside of the package from the upstream side of the low-pressure stage air-cooled heat exchanger and bypasses the cooling wind to the downstream side of the low-pressure stage air-cooled heat exchanger.

(12) The cooling fan is provided as a turbo fan.

(13) A member for filling an inner space of the duct is arranged at a lower part than the turbo fan.

(14) A rectifying guide for introducing the cooling air to the low-pressure stage air-cooled heat exchanger, the high-pressure stage air-cooled heat exchanger, and the lubricating oil air-cooled heat exchanger is provided on an inner surface side of the duct.

(15) A suction port for cooling the motor and a suction port for cooling the coolers are included on side surfaces of the package.

(16) A fan motor driving the cooling fan is arranged on a more upstream side of the cooling wind than the low-pressure stage air-cooled heat exchanger, the high-pressure stage air-cooled heat exchanger, and the lubricating oil air-cooled heat exchanger and also above the cooling fan.

The present subject matter can provide a compact oil free screw compressor capable of reducing noise, ensuring a cooling capability of heat exchangers, and reducing an installation area.

BRIEF DESCRIPTION OF THE SEVERAL VIEWS OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

An embodiment of the present subject matter will be described, referring to as an example a package-type oil free screw compressor including a low-pressure stage compressor main body and a high-pressure stage compressor main body.

Figure 1A:
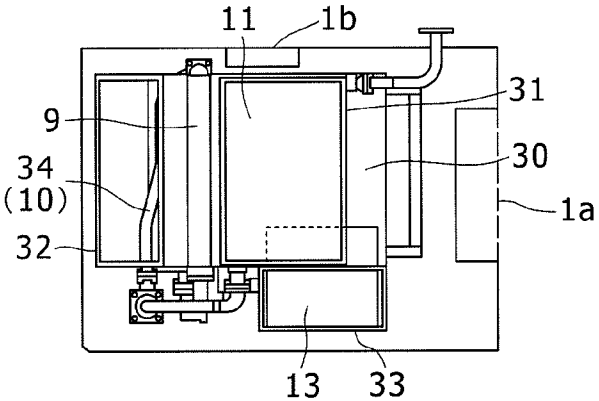
FIGS. 1A to 1D are unit structure diagrams of an oil free screw compressor.
Figure 1C:
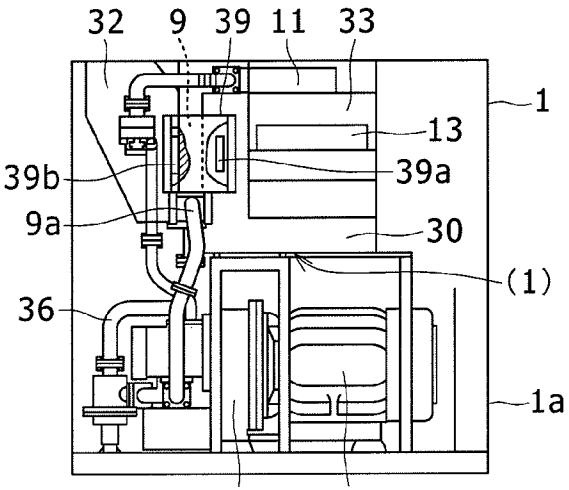
Figure 1D:
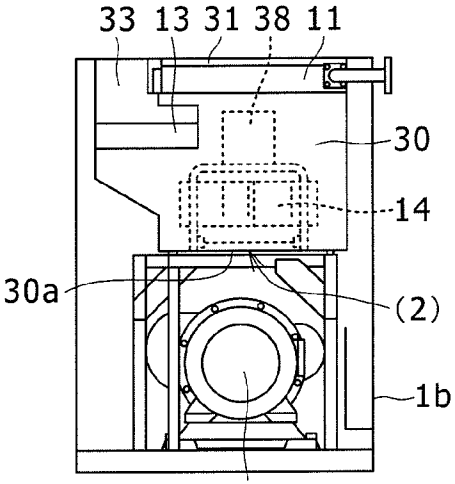
Figure 1B:
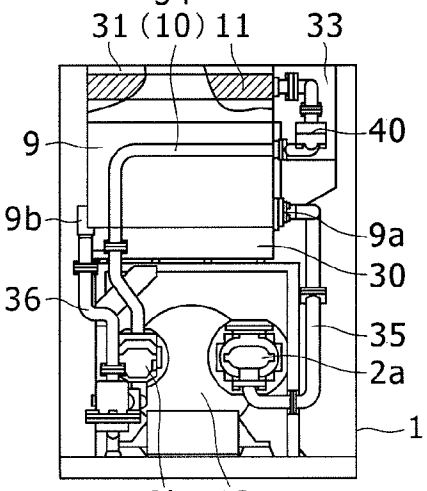
Figure 2B:
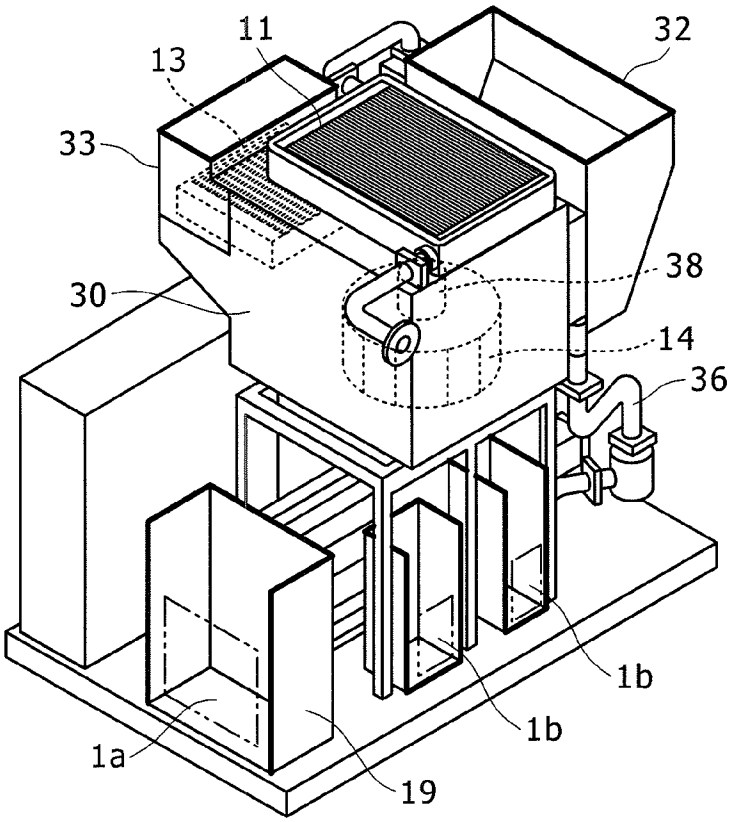
FIGS. 2A and 2B are unit structure diagrams of the oil free screw compressor.
Figure 2A:
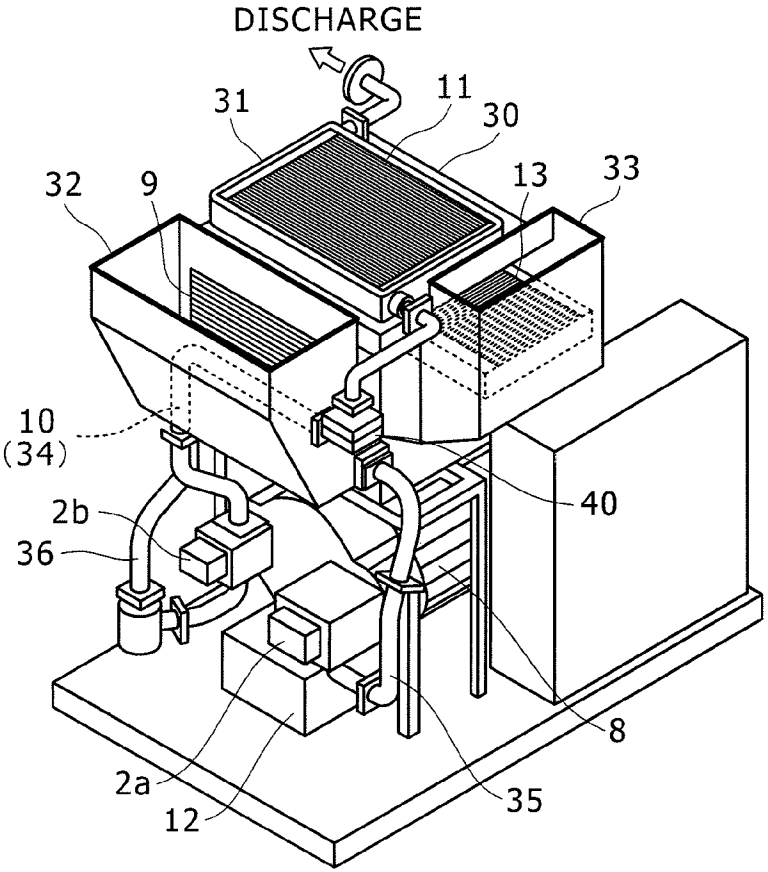
Figure 3:
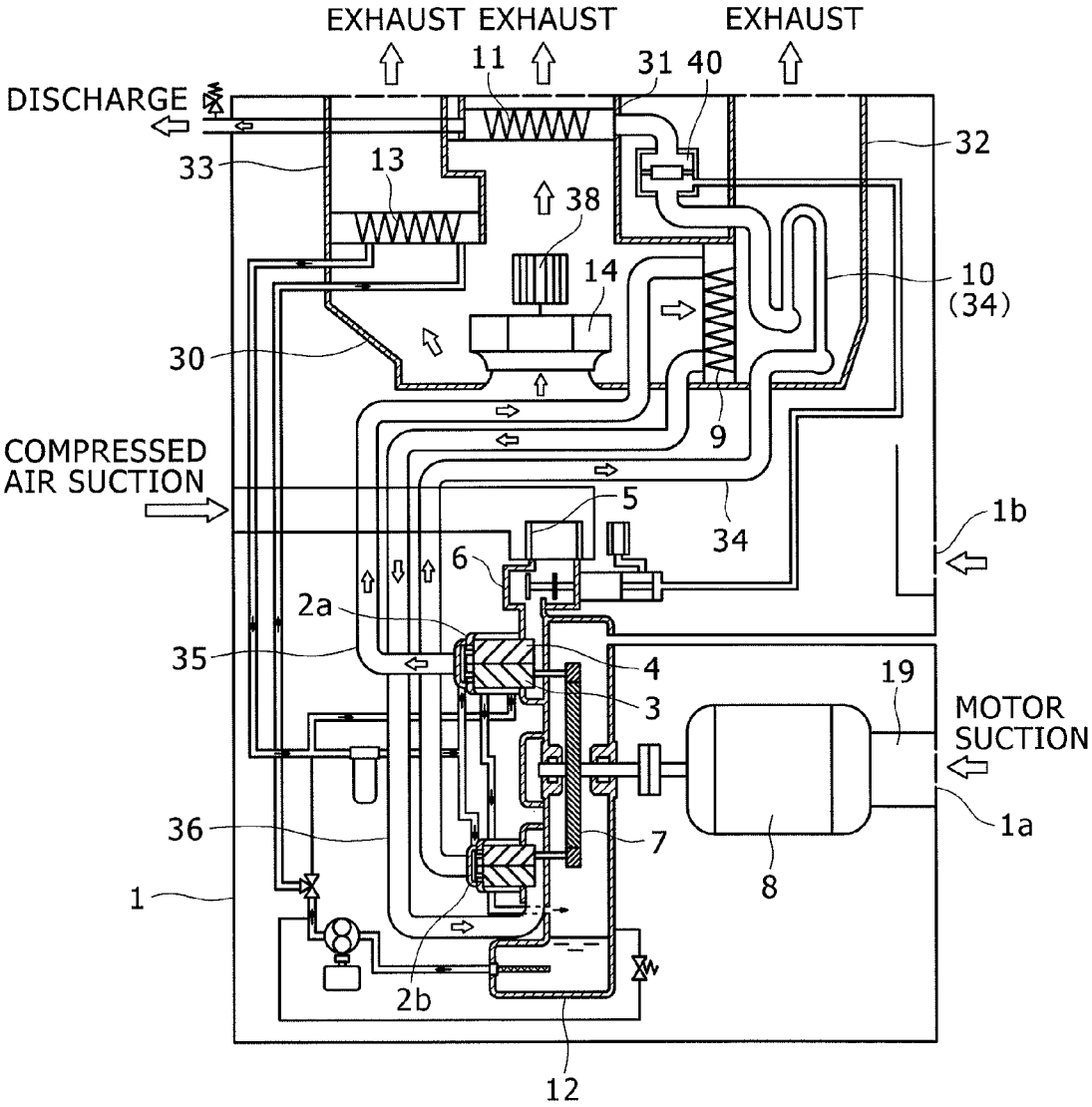
FIG. 3 is a diagram showing a structure of the oil free screw compressor and flows of compressed air and lubricating oil.
Figure 4:
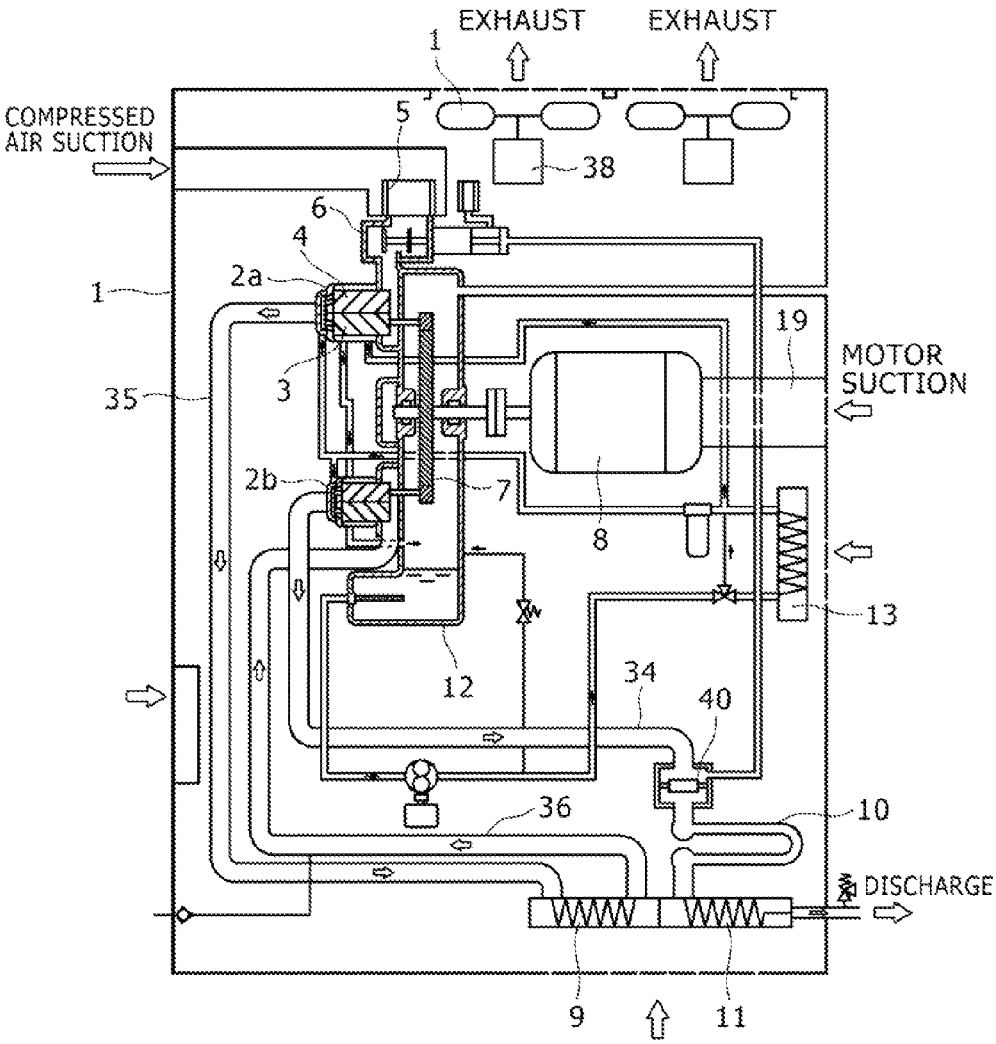
FIG. 4 is a diagram showing a structure and flows of compressed air and lubricating oil of a comparative example.

FIGS. 1A to 1D, 2A and 2B are unit structure diagrams of the oil free screw compressor according to the embodiment. FIG. 3 is a diagram showing a structure and flows of compressed air and lubricating oil of the oil free screw compressor according to this embodiment. FIG. 4 is a diagram showing a comparative example, and more specifically, a diagram showing a structure and flows of compressed air and lubricating oil of an oil free screw compressor according to the comparative example.

Hereinafter, the comparative example shown in FIG. 4 will be described, and first organizing technical problems associated with this comparative example, this embodiment will be described.

In FIG. 4, the oil free screw compressor stored in a compressor package 1 is a two-stage compressor, and includes a low-pressure stage compressor main body 2*a* and a high-pressure stage compressor main body 2*b*. Upstream of a suctioned gas path of this low-pressure stage compressor main body 2*a*, a suctioning throttle valve 6 is provided. Moreover, the compressor main bodies described above store a male rotor 3 and a female rotor 4 as a pair of screw rotors in a compression chamber. The male and female rotors 3 and 4 are disposed rotatably in an oil free and contactless state, and have an outer peripheral part formed with a groove of a volume-variable gas path.

The both compression main bodies 2*a* and 2*b* described above are driven into rotation by a compressor main body driving motor 8 via a driving gear 7. Gas used for compression is taken at normal temperature from outside by a suction filter 5. Provided in the compressor package 1 are a plurality of internal and external communication holes, which function as an air suction port or an air exhaust port. The suction port is provided with an air path shape 19. Air supplied to the low-pressure stage compressor main body 2*a* and compressed therein passes through a low-pressure stage air-cooled heat exchanger (hereinafter referred to as inter cooler) 9 via a pipe 35 to be cooled and then is supplied to the high-pressure stage compressor main body 2*b* via a pipe 36.

The air further compressed by the high-pressure stage compressor main body 2*b* circulates through a pipe 34. The pipe 34 is provided with a check valve 40 and a heat exchanger, and the compressed air passes through a front stage heat exchanger (hereinafter referred to as pre-cooler) 10 which is provided for a high-pressure stage air-cooled heat exchanger (hereinafter referred to as after-cooler) 11 and which is arranged upstream of the after-cooler 11 when necessary, is then supplied to the after-cooler 11, and then is discharged to outside of the compressor unit.

Here, the reason why the pre-cooler is arranged is because in case a compression ratio of the low-pressure stage compressor main body 2*a* and the high-pressure stage compressor main body 2*b* is increased, discharged air temperature may exceed heat-proof temperature of the inter cooler 9 or the after cooler 11 or such a temperature that shortens a life. In this case, for the purpose of heat fatigue protection, the pre-cooler needs to be arranged for the inter cooler 9, the after cooler 11, or both.

Moreover, lubricating oil filled in a gear case 12 is cooled to appropriate temperature by a compressor lubricating oil air-cooled heat exchanger (hereinafter referred to as oil cooler) 13, is then supplied to a compressor bearing including inside of the compressor main bodies and the driving gear 7 for the purpose of cooling and rotational lubrication, and is collected to the gear case 12 again. While the lubricating oil needs to be supplied to the driving gear 7 and a bearing portion of the compressor main bodies, this embodiment refers to an oil free compressor adopting a structure having no lubricating oil mixed onto an air circulation path. Therefore, a path of the compressed air is structured such that the lubricating oil circulates in a path isolated from that of the compressed air and is cooled by the oil cooler 13 provided in the isolated path.

In the comparative example shown in FIG. 4, the inter cooler 9, the after cooler 11, and the oil cooler 13 are arranged on a back surface of the compressor unit, and cooling wind of each cooler is exhausted from a package top part to outside by a cooling fan 14 provided upwardly in the package. The cooling fan 14 is rotated by a fan motor 38, and driving of this fan motor 38 guides air from outside of the package, and heat exchange therewith cools the compressed air and the lubricating oil.

In order to lower pressure loss and guide cooling wind at the lowest possible temperature to each cooler, a cooling wind path surface has been usually configured to be exposed to the outside of the package. Thus, there has arisen a drawback such that noise easily leaks from inside of the unit to the outside. Further, since the cooling fan 14 is exposed to the outside of the package, there has arisen a drawback such that fan noise easily leaks to the outside. Moreover, as in this comparative example, in a case where the coolers 9, 11, and 13 are aligned on the package back surface, a distance between the low-pressure stage compressor main bodies 2*a* and 2*b* and each of the coolers 9 and 11 increases, which not only complicate configuration of a discharged gas pipe but also results in very high-cost pipes (for example, pipes 34, 35, and 36) since they are formed of a stainless material.

To solve the problems described above, a unit structure of an oil free screw compressor having air-cooled heat exchangers having actual positional relationship of this embodiment will be described referring to FIGS. 1A to 3. FIGS. 1A, 1B, 1C, and 1D show one example of a top view, a left side view, an elevation view, and a right side view (definition of right and left will be also taken over in the description below). FIGS. 2A and 2B are perspective views showing a unit structure of the compressor of this embodiment. FIG. 2A is the perspective view from let top of a front side, and FIG. 2B is the perspective view from far right top of a back side. FIG. 3 is the diagram showing the structure of the compressor together with the flows of compressed air and lubricating oil of this embodiment. Portions in common with those of the comparative example described above (FIG. 4) are provided with the same numerals and their overlapping description will be omitted.

In this embodiment, compressor main bodies 2*a* and 2*b* and a compressor driving motor 8 are included at a bottom part of a package 1, a duct 30 is provided on a top side thereof, an inter cooler 9 is arranged on a left side surface of the duct 30, an after cooler 11 is arranged on a top surface thereof, and an oil cooler 13 is arranged on a front surface thereof. Inside of the duct 30, a cooling fan 14 is arranged, and on a bottom surface of the duct 30, a suction port 30*a* is provided. Downstream of the coolers 9, 11, and 13, exhaust ducts 31, 32, and 33 are respectively provided which are connected to the top surface of the package 1. Cooling air is suctioned by the cooling fan 14 from the suction port 30*a* into the duct 30, passes through the coolers 9, 11, and 13, and is exhausted upwardly of the package 1 via the exhaust ducts 31, 32, and 33. On a right side of the duct 30, no cooler is arranged since a drier (not shown) for removing moisture from compressed air discharged from the after cooler 11 is arranged. In the package 1, suction ports 1*a* and 1*b* are provided, and cooling air suctioned from the suction port 1*a* is suctioned into the duct 30 from the suction port 30*a* after cooling the motor 8, and air suctioned from the suction port 1*b* is directly suctioned into the duct 30 from the suction port 30*a*.

In this embodiment, the inter cooler 9, the after cooler 11, and the oil cooler 13 are arranged in a circumferential direction of the cooling fan 14 and on a top side thereof. That is, provided is a structure such that the inter cooler 9 and the oil cooler 13 are arranged on side surfaces of the duct 30 and exhaust is performed upwardly of the package 1 via the exhaust ducts 32 and 33. Illustrated in this embodiment shown in FIGS. 1A to 1D are examples in which the oil cooler 13 is arranged horizontally on the side surface of the duct 30. FIG. 5 to be described below shows an example in which the oil cooler 13 is arranged vertically on the side surface of the duct 30. This permits configuration such that the inter cooler 9 and the oil cooler 13 are not directly exposed to the outside of the package 1, suppressing sound leak from the inside of the unit to reduce noise of the package-type compressor unit.

Further, arranging the coolers on the side surfaces and the top surface of the duct 30 can more downsize and simplify the duct, compared to a case where the coolers are arranged on a suction side as in the comparative example. Further, the coolers are arranged on the different surfaces of the duct 30, thus providing degrees of freedom in sizes of the coolers. Further, in the comparative example, the cooling fan 14 is structured to be directly visible from the outside of the package, so that the fan noise easily leaks to the outside of the package 1, but as in this embodiment, arranging the cooling fan 14 inside of the duct 30 upstream of the coolers 9, 11, and 13 can prevent noise generated from the cooling fan 14 from leaking directly to the outside of the package 1.

Moreover, in this embodiment, making vertical arrangement of an inter cooler inlet 9*a* and an inter cooler outlet 9*b* on the side surfaces of the duct 30 so that the inter cooler inlet 9*a* is located on a low-pressure stage compressor 2*a* side and the inter cooler outlet 9*b* is located on a high-pressure stage compressor 2*b* side drastically shortens a pipe 35 connecting together the low-pressure stage compressor 2*a* and the inter cooler inlet 9*a* and a pipe 36 connecting together the inter cooler outlet 9*b* and the high-pressure stage compressor 2*b*, compared to a pipe root of the comparative example. This can drastically reduce pressure loss of the pipes and achieve performance improvement. Moreover, the pipes 35 and 36 are formed of a high-cost stainless material, and thus great cost reduction can be achieved through pipe length shortening. Moreover, the pipe length shortening can also reduce an increase in noise caused by pipe vibration.

Moreover, in this embodiment, the oil cooler 13 is horizontally arranged on the front surface of the duct 30, and is arranged in a manner such as to partially overlap a lower side of the after cooler 11 when viewed of the top of the duct 30. Here, in a case where the oil cooler 13 is vertically arranged on the front surface of the duct 30, a space on a front side of the duct 30 in the package 1 is narrow and thus a space in the exhaust duct 33 of the oil cooler 13 is narrow, air temperature in the exhaust duct 33 increases by high-temperature exhaust air of the oil cooler 13, and cooling efficiency of the oil cooler 13 deteriorates. Providing the structure of this embodiment permits smooth exhaust of the high-temperature exhaust air of the oil cooler 13 via the oil cooler 13 and prevention of the deterioration in the cooling efficiency of the oil cooler 13. Moreover, superposing the oil cooler 13 and the after cooler 11 on each other as in this embodiment can reduce a radiation area and also provides a useful structure for noise.

Moreover, in this embodiment, a pipe 34 connecting together the high-pressure stage compressor 2*b* and the after cooler 11 penetrates through the exhaust duct 32 of the inter cooler 9, or a pre-cooler 10 (not shown) is arranged therein. Temperature of compressed air supplied to the pre-cooler 10 is higher than temperature of compressed air supplied to the inter cooler 9, and thus the inter cooler 9 is arranged in the exhaust duct 32 since even cooled wind (exhaust wind) that has passed through the inter cooler 9 can be satisfactorily subjected to heat exchange.

As in this embodiment, connecting the pipe 34 or the pre-cooler 10 located between the high-pressure stage compressor 2*b* and the after cooler 11 to the after cooler 11 via inside of the exhaust duct 32 permits connection between the high-pressure stage compressor 2*b* and the after cooler 11 by a shortest route. This can achieve drastic reduction in pipe pressure loss and performance improvement. Moreover, the pipe 34 is formed of a high-cost stainless material, and thus drastic initial cost reduction can be achieved by the shortening of the pipe length. Moreover, arranging the pipe 34 or the pre-cooler 10 in the exhaust duct 32 provides effect that noise generated from the pipe 34 or the pre-cooler 10 can be absorbed by the exhaust duct 32.

Moreover, in this embodiment, a rectifying plate (not shown) is provided upstream of the after cooler 11 to permit a flow of much of the cooling wind to a low-temperature side of the after cooler 11, thereby improving cooling efficiency of the after cooler 11. Alternatively, a high-temperature air exhaust part downstream of the after cooler 11 is covered to permit the flow of much of the cooling wind to the low-temperature side of the after cooler 11, thereby improving the cooling efficiency of the after cooler 11.

Moreover, in this embodiment, a low-temperature exhaust side of the exhaust duct 32 of the inter cooler 9 is partially covered to permit a flow of low-temperature exhaust air to a high-temperature exhaust side, thereby achieving averaging of exhaust temperature and prevention of an outer front surface of the package 1 from being heated by high-temperature exhaust air.

Moreover, in this embodiment, a rectifying plate (not shown) is provided at the exhaust duct 32 of the inter cooler 9 or an outlet part of the exhaust duct 32 is narrowed as shown in the figure to permit a flow of even more cooling wind to the pre-cooler 10, improving the cooling efficiency of the pre-cooler 10.

Moreover, in this embodiment, a cover 39 is provided which permits communication between an opening part 39*a* provided at the duct 30 and an opening part 39*b* provided at the exhaust duct 32, the cooling wind is bypassed from an upstream side to a downstream side of the inter cooler 9 to thereby lower temperature of the exhaust wind, which has increased to high temperature after cooling of the inter cooler 9, an increase in temperature of a front surface of the exhaust duct 32 is suppressed, heating of air inside the package 1 is suppressed, and an increase in temperature of the cooling wind cooling each cooler is suppressed, whereby the cooling efficiency is improved. Moreover, a high-temperature part (for example, the check valve 40) in the package 1 can be arranged inside the cover 39 and cooling can be performed with the cooling wind to thereby suppress a temperature increase inside of the package 1.

Figure 5A:
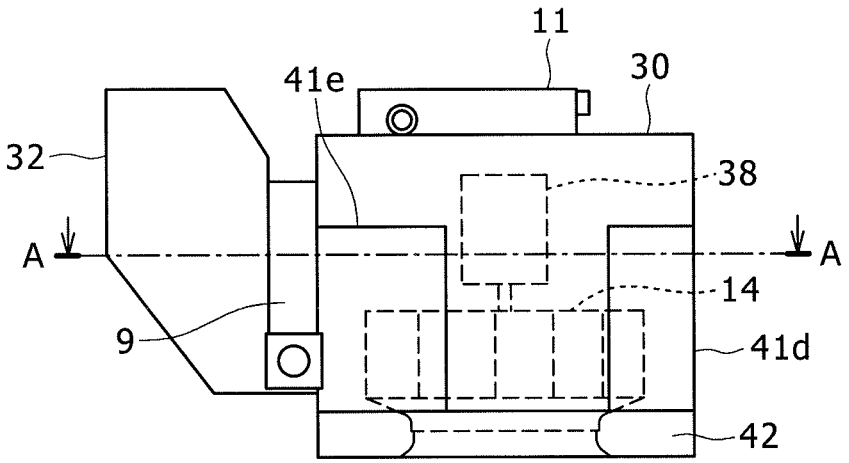
FIGS. 5A and 5B are diagrams showing an example in which a rectifying guide is arranged around a cooling fan.
Figure 5B:
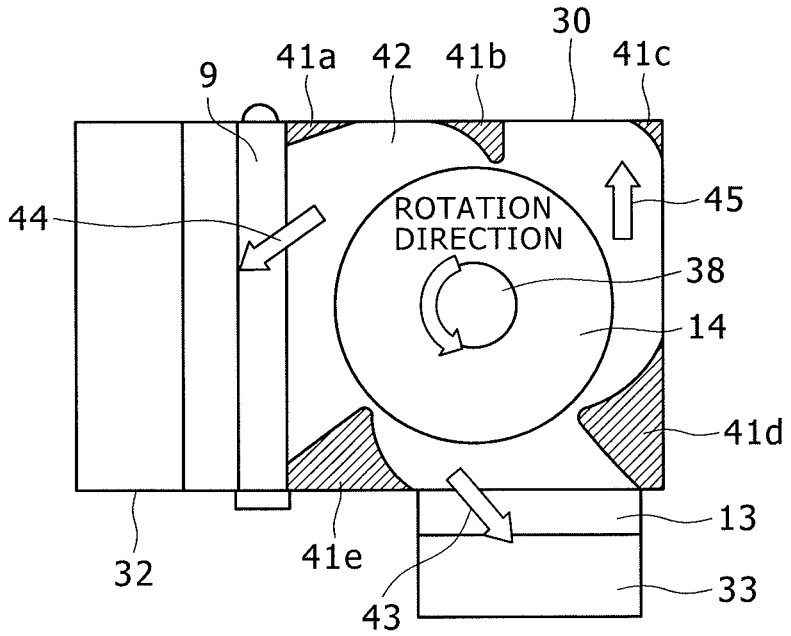

An even more preferable example will be described, referring to FIGS. 5A and 5B. FIGS. 5A and 5B show an example in which a rectifying guide is provided around the cooling fan 14.

As shown in FIGS. 5A and 5B, the cooling fan 14 is provided as a turbo fan and a member 42 is arranged in a dead space through which air below the turbo fan 14 does not flow, thereby improving efficiency of the turbo fan. The inventors of the subject matter have found that an amount of cooling wind increases.

Moreover, in a case where a propeller fan is used for the cooling fan 14 as in the comparative example or a conventional art, since the propeller fan can feed cooling wind only in an axial direction, improving the cooling efficiency requires arrangement of the coolers 9, 11, and 13 in alignment with an axial direction of the cooling fan 14, resulting in a large duct. On the other hand, the turbo fan can discharge the cooling air circumferentially, which makes it possible to arrange the coolers 9, 11, and 13 on the side surfaces of the duct 30, thus permitting downsizing of the duct 30. Further, as in this embodiment, arranging the inter cooler 9 and the oil cooler 13 on the side surfaces of the turbo fan makes it possible to provide an active flow of the cooling wind to the coolers, permitting improvement in the cooling efficiency of the coolers.

Further, the inventors of the subject matter found that, as shown in FIGS. 5A and 5B, arranging members 41*a*, 41*b*, 41*c*, 41*d* and 41*e* on an inner surface of the duct 30 and guiding in directions 43, 44, and 45 the air discharged circumferentially from the cooling fan 14 permits an efficient flow of the cooling wind to the coolers 9, 11, and 13 and permits further improvement in the cooling efficiency of the coolers.

Providing the members 41 and 42 shown in FIGS. 5A and 5B as sound-absorbing materials can provide effect that an increase in sound pressure inside of the duct 30 is suppressed, a temperature increase of the cooling wind inside the duct 30 by high-temperature air whose temperature has increased after the cooling the motor 8, heat generated from the compressor main bodies 2*a* and 2*b*, and further heat generated from, for example, the pipes 34, 35, and 36 is prevented, and deterioration in the cooling efficiency of the coolers 9, 11, and 13 is suppressed.

Here, the example of the turbo fan has been given, but the same effect can be provided by any fan that can discharge air circumferentially.

Moreover, in this embodiment, the suction port 1*a* for cooling the motor 8 and the suction port 1*b* for cooling the coolers are provided on the side surfaces of the package 1, and the cooling air which has been suctioned from the suction port 1*a* and whose temperature has increased as a result of cooling the motor 8 is mixed with air which has been suctioned from the suction port 1*b* and whose temperature has not increased to thereby suppress a temperature increase of the cooling wind suctioned to the duct 30. Needless to say, a duct is provided inside the package 1 of the suction ports 1*a* and 1*b* so that sound does not leak to the outside of the package 1.

Moreover, in this embodiment, since the fan motor 38 is arranged upstream of the coolers 9, 11, and 13, provided is effect that a temperature increase in the fan motor 38, which drives the cooling fan, as a result of discharged heat of the coolers 9, 11, and 13 is prevented.

As described above, effective usage of the inside of the compressor package permits space saving and can provide a compact oil free screw compressor with low noise and a small installation area.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. An oil free compressor system comprising:

a low-pressure stage compressor boosting air to a predetermined intermediate pressure;

a high-pressure stage compressor boosting compressed air, which was boosted to intermediate pressure, to a predetermined discharge pressure, the compressed air being boosted to the predetermined discharge pressure in a high-pressure chamber of the high-pressure stage compressor;

a motor driving the low-pressure stage compressor and the high-pressure stage compressor;

a low-pressure stage air-cooled heat exchanger cooling compressed air discharged from the low-pressure stage compressor;

a high-pressure stage air-cooled heat exchanger cooling the compressed air discharged from the high-pressure stage compressor; a main body of the high-pressure stage compressor and the low-pressure stage compressor, the main body including a bearing part; a speed changer;

a lubricating oil air-cooled heat exchanger cooling lubricating oil supplied to the bearing part of the main body of the high-pressure stage compressor and the low-pressure stage compressor, and the speed changer;

a cooling fan positioned to provide a cooling wind through the low-pressure stage air-cooled heat exchanger, the high-pressure stage air-cooled heat exchanger, and the lubricating oil air-cooled heat exchanger;

a duct arranged above the low-pressure stage compressor, the high-pressure stage compressor, and the motor in a package, the cooling fan being positioned in the duct and supplying cooling wind in a circumferential direction, and the package covering the motor, a low pressure stage air-cooled heat exchanger, a high-pressure stage air-cooled heat exchanger, a lubricating oil air-cooled heat exchanger, the cooling fan and the duct;

wherein the low-pressure stage air-cooled heat exchanger, the high-pressure stage air-cooled heat exchanger are arranged in a circumferential direction, and the lubricating oil air-cooled heat exchanger is arranged at a top surface side of the cooling fan in the duct, the cooling fan is provided inside of the duct, upstream of and separated by a distance from each of the low-pressure stage air-cooled heat exchanger, the high-pressure stage air-cooled heat exchanger, and the lubricating oil air-cooled heat exchanger; and an exhaust duct is disposed downstream of each of the low-pressure stage air-cooled heat exchanger, the high-pressure stage air-cooled heat exchanger, and the lubricating oil air-cooled heat exchanger, each of the exhaust ducts connecting one of the heat exchangers to a top surface of the package.

2. The oil free compressor system according to claim 1, wherein the high-pressure stage air-cooled heat exchanger is arranged on a top surface of the duct, and the low-pressure stage air-cooled heat exchanger and the lubricating oil air-cooled heat exchanger are respectively arranged on different side surfaces of the duct.

3. The oil free compressor system according to claim 2, wherein the low-pressure stage air-cooled heat exchanger is vertically arranged such that compressed air inlet and outlet of the low-pressure stage air-cooled heat exchanger are respectively located on a side of the low-pressure stage compressor and a side of the high-pressure stage compressor.

4. The oil free compressor system according to claim 3, further comprising a passage provided which bypasses the cooling wind from the upstream side to a downstream side of the low-pressure stage air-cooled heat exchanger.

5. The oil free compressor system according to claim 2, wherein the lubricating oil air-cooled heat exchanger is arranged on a lower side of the high-pressure stage air-cooled heat exchanger in a manner such as to partially overlap the high-pressure stage air-cooled heat exchanger when viewed from top of the exhaust duct.

6. The oil free compressor system according to claim 2, further comprising a part of a pipe connecting together the high-pressure stage compressor and the high-pressure stage air-cooled heat exchanger arranged in the exhaust duct provided downstream of the low-pressure stage air-cooled heat exchanger.

7. The oil free compressor system according to claim 6, further comprising a passage provided which passes through a high temperature part inside of the package from the upstream side of the low-pressure stage air-cooled heat exchanger and bypasses the cooling wind to the downstream side of the low-pressure stage air-cooled heat exchanger.

8. The oil free compressor system according to claim 7, further comprising a retainer of an inner space of the duct shaped so as to be covered by the duct, except for the inlet port of the cooling fan.

9. The oil free compressor system according to claim 8, wherein the retainer is made of a sound absorbing materials.

10. The oil free compressor system according to claim 7, further comprising a rectifying guide provided in a near down stream side of the cooling fan on an inner surface side of the duct, the rectifying guide being configured to distribute the cooling wind in each direction to the low-pressure stage air-cooled heat exchanger, the high-pressure stage air-cooled heat exchanger, and the lubricating oil air-cooled heat exchanger.

11. The oil free compressor system according to claim 10, wherein the rectifying guide is made of a sound absorbing materials.

12. The oil free compressor system according to claim 2, further comprising a front-stage air-cooled heat exchanger included on an upstream side of the high-pressure stage air-cooled heat exchanger, and the front-stage air-cooled heat exchanger is arranged in an exhaust duct coupling between the low-pressure stage air-cooled heat exchanger and the package.

13. The oil free compressor system according to claim 2, further comprising an air exhaust part that carries a high-temperature air downstream of the high-pressure stage air-cooled heat exchanger is covered rectifying plate.

14. The oil free compressor system according to claim 2, further comprising a low-temperature side of the exhaust duct of the low-pressure stage air-cooled heat exchanger covered rectifying plate.

15. The oil free compressor system according to claim 1, wherein the cooling fan is a turbo fan.

16. The oil free compressor system according to claim 1, further comprising a suction port for cooling the motor and a suction port for cooling the heat exchangers included on side surfaces of the package.

17. The oil free compressor system according to claim 1, further comprising a fan motor driving the cooling fan arranged on a more upstream side of the cooling wind than the low-pressure stage air-cooled heat exchanger, the high-pressure stage air-cooled heat exchanger, and the lubricating oil air-cooled heat exchanger and also above the cooling fan.

* * * * *